United States Patent [19]

Imai et al.

[11] Patent Number: 4,666,815

[45] Date of Patent: May 19, 1987

[54] METHOD FOR DEVELOPING ELECTROSTATIC LATENT IMAGE WITH NON-MAGNETIC TONER

[75] Inventors: Eiichi Imai, Narashino; Masaki Uchiyama, Tokyo; Motoo Urawa, Funabashi; Atsuko Yamamoto, Komae, all of Japan

[73] Assignee: Canon Kabushiki Kaisha, Tokyo, Japan

[21] Appl. No.: 658,519

[22] Filed: Oct. 9, 1984

[30] Foreign Application Priority Data

Oct. 19, 1983 [JP] Japan ..... 58-195607

[51] Int. Cl.[4] ..... G03G 13/14

[52] U.S. Cl. ..... 430/126

[58] Field of Search ..... 430/120, 122, 126; 115/653, 657, 658

[56] References Cited

U.S. PATENT DOCUMENTS

| | | | |
|---|---|---|---|
| 3,914,460 | 10/1975 | Maksymiak | 430/120 |
| 4,297,384 | 10/1981 | Kudo et al. | 430/120 |
| 4,444,864 | 4/1984 | Takahashi | 118/657 |

*Primary Examiner*—John L. Goodrow

*Attorney, Agent, or Firm*—Fitzpatrick, Cella, Harper & Scinto

[57] ABSTRACT

A method for developing electrostatic latent images formed on an electrostatic image bearing member, particularly by a thin and uniform layer of toner formed on a toner carrying member. In the method, good images can be stably obtained by controlling the gross electric charge per unit area within the range of $3\times10^{-10}$ to $10^{-7}$ coulomb/cm$^2$ in terms of the absolute value thereof and the packing density within the range of 0.1 to 0.6 g/cm$^3$ with respect to the toner layer carried on the toner carrying member at the developing station.

9 Claims, 6 Drawing Figures

METHOD FOR DEVELOPING ELECTROSTATIC LATENT IMAGE WITH NON-MAGNETIC TONER

BACKGROUND OF THE INVENTION

This invention relates to a method for developing electrostatic latent images formed on an electrostatic image-bearing member, particularly to a method for development by forming a thin and uniform toner layer on a toner carrying member.

In the prior art, the following methods have been known as methods for carrying out development by use of a substantially non-magnetic one-component toner.

One method comprises providing a movable developer-carrying means which carries, conveys and feeds a developer to a latent image (electrostatic image)-bearing member, a developer-feeding means and a movable coating means which receives feed of the developer from the developer-means and applies the developer to the above movable developer-carrying means, said movable coating means having a fiber brush for carrying the developer on its surface and contacting the above movable developer-carrying means to apply the toner uniformly to the above movable developer-carrying means at the contacted portion, while moving at higher speed in the same direction as the movable developer-carrying means than the movable developer-carrying means, and approaching the coated layer to the electrostatic latent image portion.

Another method comprises providing a rotatable magnetic roller for forming a magnetic brush by attracting magnetic carriers for charging one-component toner particles and a developing roller for developing electrostatic latent images on an electrostatic latent image-bearing member by transfer of the toner particles onto the roller, and developing the electrostatic images, while maintaining a gap between the electrostatic image-bearing member and the developing roller at the developing station, with the gap being set greater than the thickness of the coated toner layer on the developing roller.

Still another method known in the art comprises arranging a toner-carrying member carrying a toner on its surface so as to face an electrostatic image-bearing member, thereby developing electrostatic images on the image-bearing member, wherein the developer accumulated in a developer-storing means below the developer-carrying member is drawn up onto the developer-carrying member, while giving vibration to the developer only at the drawing-up position to activate the developer and form a developer layer to a desired thickness on the surface of the developer-carrying member, thereby developing the electrostatic images on the electrostatic image-bearing member.

In these methods, an insulating toner which can be regarded as substantially non-magnetic is carried on a carrying member at the developing station through a non-magnetic force. Thus, in these methods, the force for carrying the toner on the toner carrying member around the developing station consists predominantly of an electrostatic attracting force and a physical attaching force and, in this respect, several difficulties are encountered when compared with a conventional developing method using an insulating magnetic toner where the toner is carried on a carrying member through a magnetic force, an electrostatic force, etc. For example, most toners cannot be applied onto the carrying member to form a relatively thin uniform layer. Further, even if relatively uniformly applied, a phenomenon of so-called fogging occurs where the toner is attached to non-image portions. Further, even if applied to form a thin and uniform layer, the amount of toner attached onto image portions is insufficient to result in images of low densities. Moreover, most toners can produce poor images of low fidelity and low resolution. Most toners can cause decrease in image density or a low quality of image on repeated use. Furthermore, most toners are accompanied with such defects as decrease in image density at one time and fogging at another time, when encountered with changes in environmental conditions including high temperature and high humidity conditions and low temperature and low humidity conditions.

On the other hand, the developing method using a one-component magnetic developer is not only expensive but also is encountered with difficulty in giving beautiful chromatic images, because a large proportion of magnetic material is contained in the magnetic toner particles.

SUMMARY OF THE INVENTION

A principal object of the present invention is to provide a novel developing method having obviated the above difficulties wherein an insulating toner with a true density of 1.2 or below which can be regarded as substantially non-magnetic is used.

A more specific object of the present invention is to provide a developing method giving images with high fidelity and stable image quality.

Another object of the present invention is to provide a developing method obviating fogging while giving uniform and sufficiently dense images with a high resolution.

A further object of the present invention is to provide a developing method excellent in durability such as performance in continuous use.

A still further object of the present invention is to provide a developing method which is stable in performance under a variety of environmental conditions including high temperature-high humidity and low temperature-low humidity.

A still another object of the present invention is to provide a developing method capable of giving clear chromatic images.

The developing method of the present invention comprises:

providing an electrostatic image bearing member for bearing an electrostatic image on the surface thereof and a toner carrying member for carrying a substantially non-magnetic toner on the surface thereof so that the electrostatic image bearing member and the toner carrying member face each other with a gap therebetween at a developing station, causing the toner to be carried on the toner carrying member to form a toner layer in a thickness thinner than said gap, and causing the toner to be transferred onto the electrostatic image bearing member at the developing station, wherein the toner carried on the toner carrying member has a gross electric charge per unit area of Q coulomb/cm$^2$ satisfying the relationship:

$$3\times10^{-10}\leqq|Q|\leqq10^{-7}$$

and has a packing density of 0.1 to 0.6 g/cm$^3$.

In the developing method of the present invention as described above, it is preferred to apply an alternating and/or direct current bias between the toner carrying member and the electrostatic image bearing member at the developing station, according to necessity.

DETAILED DESCRIPTION OF THE INVENTION

Figure 1:
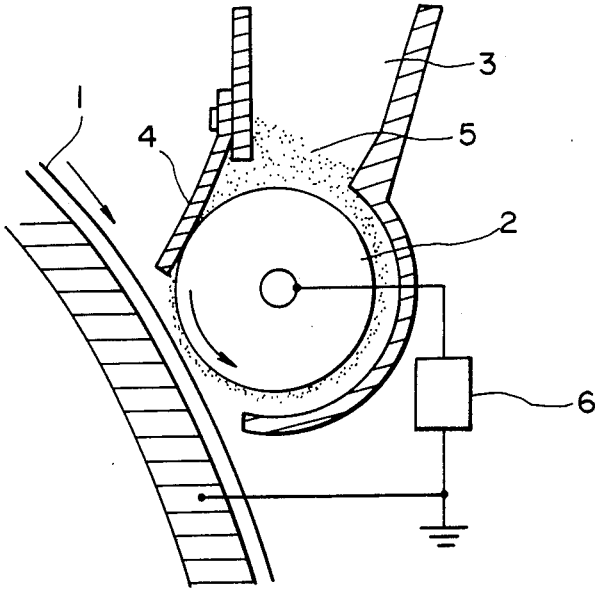
FIGS. 1 through 6 respectively show a schematic partial view in section of an exemplary developing apparatus for practicing the developing method of the present invention, wherein the like parts are expressed by the same or like reference numerals.

We have investigated the developing methods known heretofore using insulating toners which are substantially non-magnetic in various respects. As the result, we have obtained a knowledge that it is essential in this type of developing method to control the electrostatic charge of the toner on the toner carrying member at the developing station in a more accurate degree than in the developing method using magnetic toners. More specifically, in this type of developing method using an insulating toner which has a saturation magnetization measured in an external magnetic field of 5000 Oersted of 10 emu/g or below, when the charge is too low, for example, the toner cannot be uniformly applied onto the toner carrying member, thus naturally failing to effect development. On the other hand, even when the charge is increased so that the toner can be uniformly applied, if the level of the charge is not appropriate, fogging is liable to occur and, if the level is too high on the contrary, the toner cannot readily be transferred to the electrostatic image bearing member thereby to result in images of lower image density and quality. For similar reasons, the quality of the image is greatly affected by the variation in the electric charge of the toner after the repetitive use or change in environmental conditions. Accordingly, it is extremely important to secure stability of the charge. This means that the most part of the force for appropriately carrying a substantially non-magnetic toner on a toner carrying member depends on the amount or level of the charge possessed by the toner. Thus, the necessity of the accurate control of the charge level is a requisite condition characteristic to a developing method wherein a substantially non-magnetic one-component toner is carried by a non-magnetic force and used for development at the developing station.

Incidentally, as a method for measuring the charge of a toner, the so-called blow-off method has been known. The blow-off method is, however, a method for measuring a charging characteristic of a toner when sufficiently mixed with fine magnetic carrier particles and is not sufficiently applicable to a case where one-component toner particles are formed in several layers as in the developing method of the present invention. We have directly measured the gross charge of an actual toner layer on the toner carrying member by a suction-type Faraday cage method which will be explained hereinafter and obtained a kind of information which is utterly different from the conventional one and extremely effective for a developing method using a one-component toner. Based on the information, the present invention has been completed.

In the present invention, the electric charge per unit area of the toner on the toner carrying member in terms of the absolute value thereof should be from $3\times10^{-10}$ coulomb/cm$^2$ to $10^{-7}$ coulomb/cm$^2$ and preferably be from $5\times10^{-10}$ coulomb/cm$^2$ to $5\times10^{-8}$ coulomb/cm$^2$. Outside the above range, the difficulties as explained above are encountered.

Furthermore, we have found it necessary to effect a more accurate control of the packing density of the toner on the toner carrying member. In the present invention, the packing density should be 0.1 to 0.6 g/cm$^3$ and preferably be 0.15 to 0.50 g/cm$^3$. A lower packing density leads to a tendency of resulting in poor quality of images which have lost sharpness or are accompanied with a defect such as ghost or fog even if the electric charge is appropriate. On the contrary, if the packing density is excessively high, there results in a lower image density and occasionally partial dropping-off of images to leave white portions.

The toner layer having a packing density as explained above has shown good developing performance when formed in a variety of applications as will be explained hereinafter. Further, it has given good images even under various environmental conditions such as high temperature-high humidity and low temperature-low humidity and even after a long term of repetitive image formations.

As will be apparent from the above explanation, it is another essential requisite condition to control the packing density of the toner on the toner carrying member for a developing method wherein a substantially non-magnetic toner is carried by a non-magnetic force and used for development at the developing station.

The packing density of a toner layer on a carrying member used in the present invention can be calculated from the weight of the toner per unit area of the carrying member measured by the so-called Faraday cage method in combination with the thickness of the toner layer measured by a length measurer using laser.

The thickness of a coated or applied layer to be used in the present invention is preferably 15 to 100 microns and more preferably 15 to 80 microns. If the toner layer is too thin, a sufficient image density cannot be obtained and, if too thick on the contrary, fogging is liable to occur.

As briefly touched on hereinbefore, the charge and the packing density of the toner layer on the carrying member have been obtained by the so-called suction-type Faraday cage method. According to the suction type Faraday cage method, an outer tube is pushed onto a toner carrying member and all the toner on a predetermined area of the toner carrying member covered by the outer tube is captured through suction by an inner filter tube, whereby the weight of the toner on a unit area of the toner carrying member can be calculated from the increase in the weight of the filter. Simultaneously, the electric charge accumulated on the inner filter tube which was electrostatically shielded from the exterior is measured to give the charge per unit area of the toner carrying member (A more detailed description of the suction-type Faraday cage method will be found in, for example, Journal of the Electrophotographic Society, Japan, Vol. 11, No. 1).

In the present invention, the means for controlling the electric charge and the packing density of the toner are not particularly limited. These values can be controlled by various toner layer regulating means and can also be changed by selection of the toner species used as will be readily understood.

The binder resin of the toner to be used in the developing method of the invention may comprise various resins known heretofore as binder resins for toners for electrophotography. The binder resin may for example be polystyrene, a styrene polymer such as styrene-butadiene copolymer and styrene-acrylic copolymer, polyethylene, an ethylene copolymer such as ethylene-vinyl acetate copolymer and ethylene-vinyl alcohol copolymer, a phenolic resin, an epoxy resin, an allyl phtharate resin, a polyamide resin, a polyester resin, or a maleic acid resin. For any resins, the production method is not particularly limited. Heretofore, resins obtained through emulsion polymerization are difficult to use because they are liable to contain impurities, whereas they can be readily used by the present invention. Thus, the scope of available resins can be broadened by the present invention by appropriately selecting the other conditions such as the location of the magnet and the rotating speed of the toner carrying member depending on the resin used to conrol the gross electric charge and the packing density of the toner on the carrying member. This is another significant effect of the present invention.

As the colorants to be used in the toner, colorants known in the art such as carbon black, dyes and pigments may be used. Further, positive or negative charge controlling agents known in the art may also be added. Fine powder of a metal oxide such as colloidal silica may further be added, if necessary.

The production method of the present invention is not restricted in any way. For example, the toner may be produced through the steps of kneading, crushing and classification, by dispersion into a liquid or gaseous phase, or by a microencapsulation method.

The toner used in the present invention is substantially non-magnetic and can have a small true density as small as 1.2 or below because the amount of magnetic powder is small even if contained.

The present invention will be described in detail by referring to the examples and actual examples of practice.

FIG. 1 shows an example of a developing apparatus for practicing an embodiment of the developing method of the invention using a substantially non-magnetic insulating toner. In the figure, an electrostatic latent image is formed by the known Carlson process or NP process on a cylindrical electrostatic image bearing member 1. On the other hand, on a toner carrying member 2 is applied an insulating non-magnetic toner 5 in a hopper 3 as a toner supplying means by using a toner application means for applying a toner layer while regulating the thickness thereof. The electrostatic image on the image bearing member 1 is developed with the layer of toner formed on the toner carrying member 2. The toner carrying member 2 is a developing roller comprising a cylinder of stainless steel. The developing roller may be made of aluminum or another metal. The metal roller may be coated with another material such as a resin in order to triboelectrically charge the toner in a more desired polarity and intensity. Further the developing roller can be made of an electroconductive non-metallic material. At the both ends of the toner carrying member 2 are provided unshown spacer rollers made of polyethylene by the medium of the shaft of the carrying member 2 and, by abutting the spacer rollers to the both peripheral ends of the electrostatic image bearing member 1 and fixing the developing apparatus, the gap or clearance between the electrostatic image bearing member 1 and the toner carrying member 2 is set larger than the thickness of the toner layer formed on the toner carrying member 2. The gap is for example 100 to 500 microns and preferably 150 to 300 microns. When the gap is too large, the electrostatic force exerted on the non-magnetic toner applied on the toner carrying member from the electrostatic latent image on the electrostatic image bearing member 1 becomes too weak, whereby image quality is deteriorated and particularly visualization of thin lines by development becomes too difficult. On the contrary, when the gap is too small, the toner applied on the toner carrying member 2 is liable to be compressed to agglomerate with each other. A developing bias source 6 is provided to apply a voltage between the toner carrying member 2 and the electrode disposed on the back side of the electrostatic image bearing member 1. The developing bias voltage is similar to that shown in Japanese Patent Publication No. 32375/1983.

Figure 2:
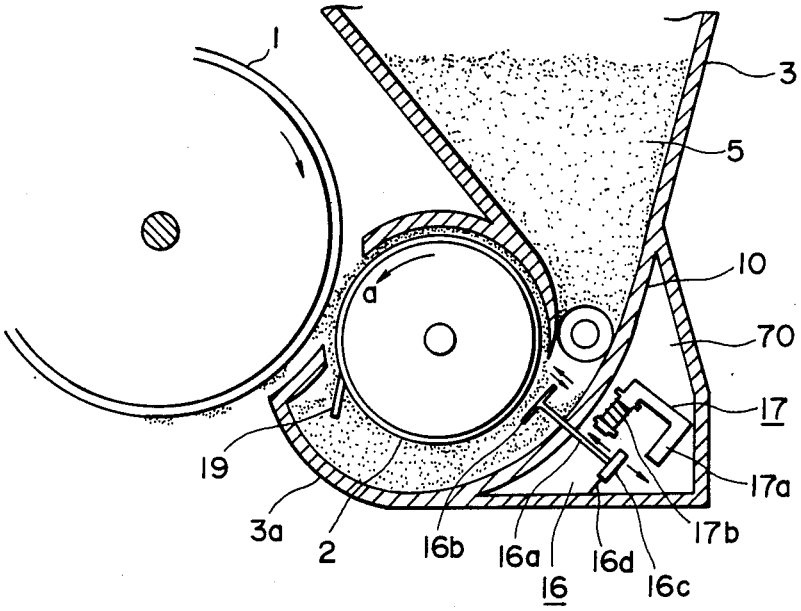

FIG. 2 shows another embodiment. The developing apparatus shown in FIG. 2 comprises an electrostatic image bearing member 1, a toner carrying member 2, a hopper 3, a toner 5, a cleaning blade 9, a toner supplying member 10, a vibrating member 16, vibration generating means 17, a permanent magnet **16*a*, a support spring 16*b*, a core 17*a*, and a winding 17*b*. An alternating current is applied to the winding 17*b* to vibrate the vibrating member 16 at an appropriate amplitude and frequency, whereby a uniformly applied layer of non-magnetic toner is formed on the toner carrying member 2. The toner carrying member 2 is faced to the electrostatic image bearing member 1 with a gap therebetween thicker than the toner layer at the developing station where the toner is caused to jump onto the electrostatic image to effect development. The degree of vibration of the vibrating member 16 is chosen as desired as far as it does not directly touch the toner carrying member 2, whereas it is preferred that the frequency and amplitude are so selected that the thickness of the toner layer will uniformly be 15 to 100 microns. It is also possible to apply an alternating and/or direct developing bias voltage between the toner carrying member 2 and the electrostatic image bearing member 1**.

Figure 3:
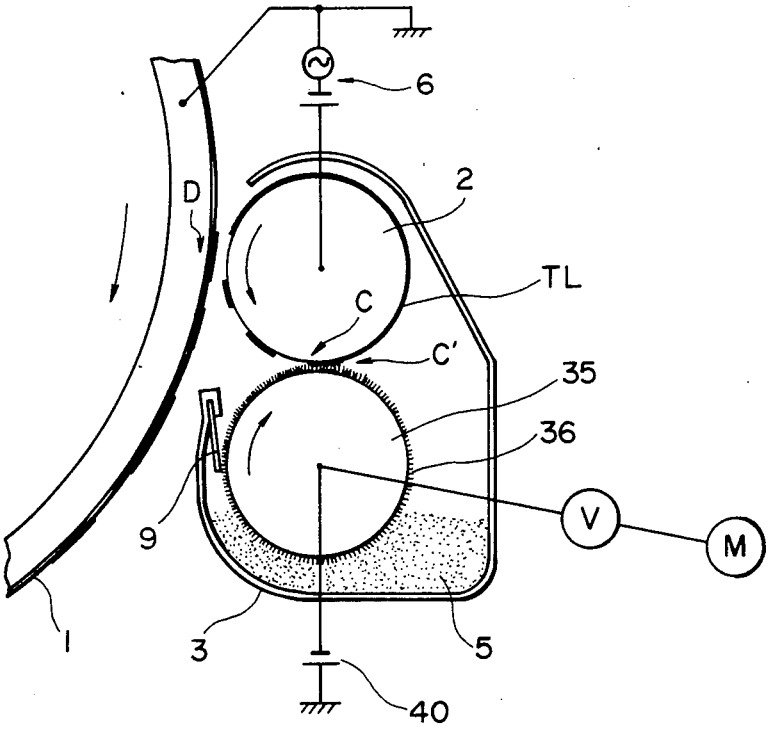

FIG. 3 shows another embodiment. In FIG. 3 is shown a developing apparatus comprising an electrostatic image bearing member 1, a toner carrying member 2, a developing vessel 3 containing a toner 5, a developing bias source 6, a toner cleaning member 9, an application roller 35, a fiber brush affixed to the surface of the roller 35, and a bias source 40 for application. The toner 5 is transferred and uniformly applied onto the toner carrying member 2 by the brush 36 affixed to the rotating application roller 35. A thin layer TL of the toner is then caused to jump onto an electrostatic image on the image bearing member 1 at the developing station D. The gap between the toner carrying member 2 and the application roller 35 is so adjusted to form a uniform toner layer TL in a thickness of the order of 15 to 100 microns. Herein, a bias voltage may be applied from the bias source 40 in order to effect uniform application of the toner. The gap between the electrostatic image bearing member 1 and the toner carrying member 2 is set to be larger than the above-mentioned toner thickness. During the development, a bias voltage may be applied between the image bearing member 1 and the toner carrying member 2 from the bias source 6 for development.

Figure 4:
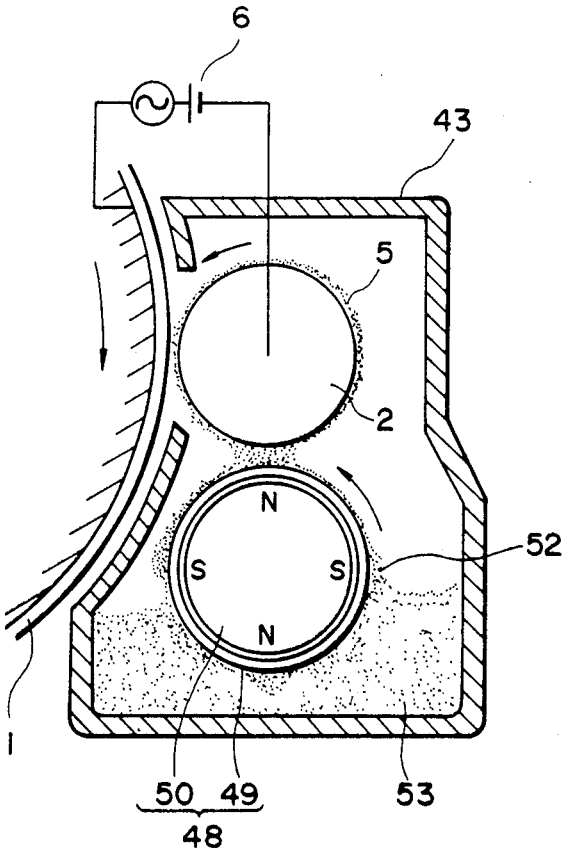

FIG. 4 shows another embodiment. In the figure is shown a developing apparatus comprising an electrostatic image bearing member 1, a toner carrying member 2 for carrying a toner 5, a developing vessel 43, a magnetic roller 48, a non-magnetic sleeve 49 of the magnetic roller 48, a magnet 50, a magnetic brush 52, a one-component toner 53 or a two component developer 53 comprising a mixture of a toner and magnetic particles. Magnetic particles are held by a magnetic force on the non-magnetic sleeve 49 to form a magnetic brush, which is rotated with the rotation of the sleeve 49 to draw up the toner or developer 43 and applying by contact the toner on the toner carrying member 2, whereby a uniform toner layer 5 is formed. At this time, the magnetic particles are held on the magnetic roller 48 by a magnetic force and therefore not transferred onto the toner carrying member 2. The toner applied on the toner carrying member 2 is caused to jump onto the electrostatic image bearing member to effect development. The gap between the magnetic roller 48 and the toner carrying member 2 is adjusted so as to form a toner layer with a thickness of the order of 15 to 100 microns. The gap between the electrostatic image bearing member 1 and the toner carrying memer 2 is set to be larger than the above-mentioned toner thickness, and a bias voltage for development may be applied to the toner carrying member 2.

Figure 5:
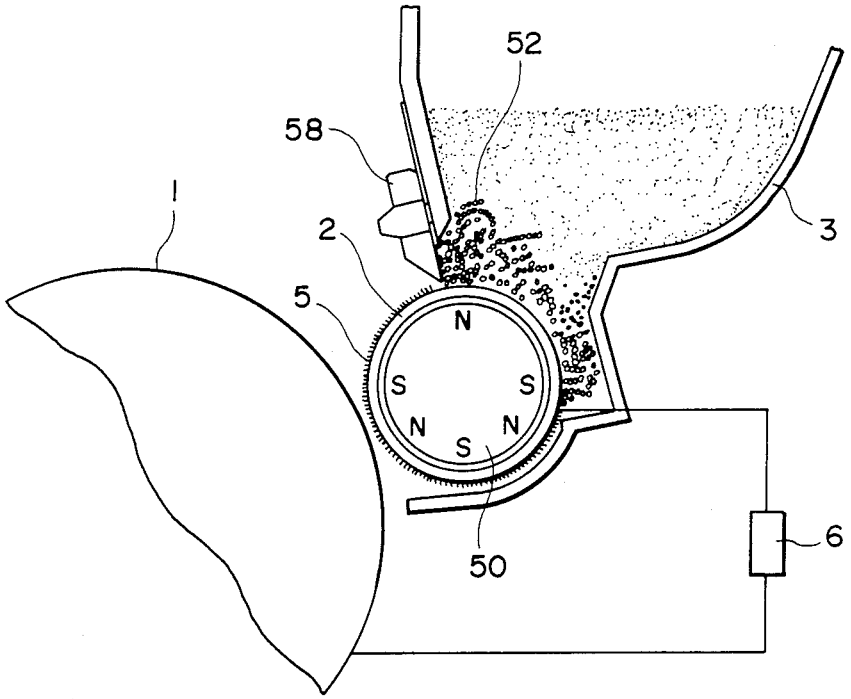

FIG. 5 shows still another embodiment. The developing apparatus shown in the figure comprises an electrostatic image bearing member 1, a toner carrying member 2 for carrying a toner 5, a hopper 3, a bias source for development 6, a fixed magnet 50, a magnetic brush 52 comprising a mixture of magnetic particles and the toner. The magnetic brush 52 formed on the toner carrying member 2 is caused to circulate by rotating the toner carrying member 2, whereby the toner in the hopper 3 is drawn into the magnetic brush and applied to form a uniformly thin layer of the toner. The toner carrying member 2 is faced to the image bearing member 1 with a gap therebetween larger than the toner layer thickness, whereby the toner is caused to jump onto the electrostatic image on the electrostatic image bearing member 1. The electric charge and thickness of the toner layer are controlled by the size of the magnetic brush 52 and the degree of circulation thereof. The gap between the electrostatic image bearing member and the toner carrying member is set larger than the thickness of the toner layer, and a developing bias may be applied by a bias source for development.

Figure 6:
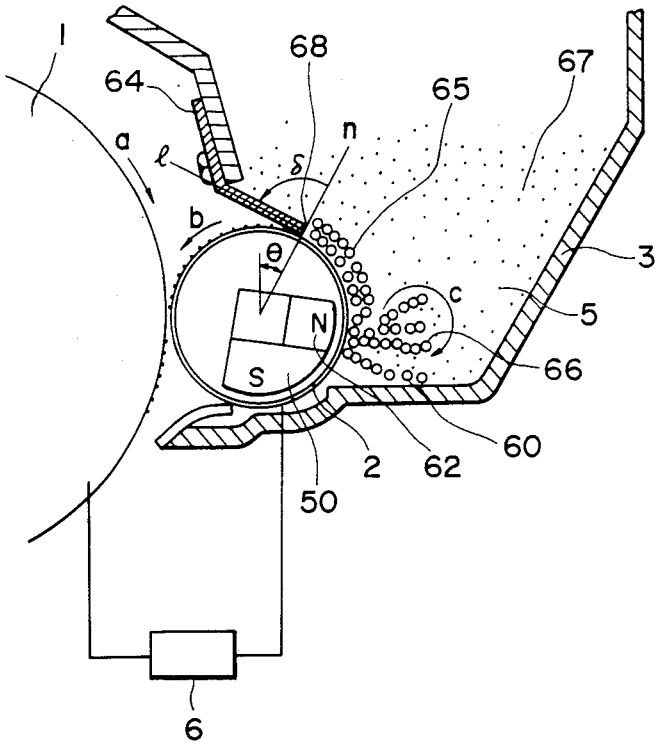

FIG. 6 shows a still further embodiment of the present invention. In FIG. 6, a cylindrical photosensitive member for electrophotography 1 is rotatable in the direction shown by arrow a. Facing the photosensitive member 1 is provided a non-magnetic sleeve 2 as a toner carrying member with a gap therebetween. The sleeve 2 rotates in the direction shown by arrow b along with the movement of the photosensitive member 1. Inside the sleeve 2 is provided a fixed magnet 50 as a magnetic field generating means. A hopper 3 as a developer supplying container accommodates a developer mixture comprising a toner 5 and magnetic particles 60 in combination with the sleeve 2. A magnetic brush is formed of magnetic particles 60 in the neighborhood of the surface of the sleeve 2 corresponding to the magnetic pole 62 of the magnet 60. When the sleeve 2 is rotated in the direction of arrow b, the magnetic brush circulates in the direction of arrow c in the neighborhood of the magnetic pole 62 to form a circulating layer 66 by appropriately selecting the place of arrangement of the magnetic pole 62 and the circulatability and the magnetic characteristics of the magnetic particles 60.

On the other hand, at point 68 downstream of the magnetic pole 62 with respect to the rotational movement of the sleeve is disposed a magnetic blade 64 of a magnetic material as a means for confining magnetic particles with an appropriate gap from the sleeve 2 and with its center line 1 forming an angle $\delta$ with respect to a normal at point 68 against the sleeve 2 slanted in the downstream direction with respect to the movement of the sleeve 2. Magnetic particles 60 are confined at the point 68 on the surface of the sleeve 2 by the balance of gravity, a magnetic force and a confining force due to the presence of the magnetic blade 64 to form a stationary layer 65 within which magnetic particles can be slightly movable but are almost immobile. Thus, a magnetic particle layer comprising the circulating layer 66 and the stationary layer 65 is formed on the sleeve 2. The magnetic particle layer contains toner 5. While the magnetic particles in the stationary layer 65 are confined on the sleeve due to the balance between the above mentioned confining force and the conveying force, the toner is not confined by the magnetic field given by the magnetic pole 62, because it is substantially non-magnetic, and applied to form a uniformly thin layer due to the image force. The thus applied toner is conveyed along with the rotation of the sleeve to face the photosensitive member 1 and is used for developing.

In the circulation layer 66, magnetic particles forming a magnetic brush circulate as shown by arrow c due to gravity, a magnetic force exerted by the magnetic pole, a frictional force and circulatability (viscosity) of the magnetic force. During the circulation, the magnetic brush takes in toner 5 from the developer layer 67 above the magnetic particle layer to return to the lower part of the hopper 3. Thus, the circulation is repeated. The magnetic blade 64 is not directly concerned in the circulation.

As the developing method used herein, one disclosed in Japanese Patent Publication No. 32375/1983 is preferred. Between the electrophotographic photosensitive member 1 and the toner carrying member is applied a voltage from the bias source 6. The bias source may be of an alternating or direct current but should preferably be of a direct current-superposed alternating current. The developer to be used for development is supplied from the circulating layer 66 to the toner carrying member 2 and the shortage of toner in the circulating layer 66 is compensated by the supply of a toner from the developer layer 67 due to the above mentioned circulation.

The present invention will further be explained by referring to actual examples of practice. In the following description, "parts" used for referring to quantities are all by weight.

EXAMPLE 1

A mixture comprising 100 parts of styrenebutyl methacrylate copolymer, 10 parts of a phthalocyanine-type blue pigment and 2 parts of a nigrosine dye was well blended in a blender and kneaded on a twin roll heated to 150° C. The kneaded product was left to cool, coarsely crushed by a cutter mill, pulverized by means of a micropulverizer with a jet air stream and further subjected to classification by use of a wind force classifier to obtain colored fine powder (toner) with particle sizes of 5 to 20 microns. The true specific gravity of the toner was 1.07.

On the other hand, a mixture comprising 100 parts of zinc oxide, 20 parts of styrene-butadiene copolymer, 40 parts of n-butyl methacrylate, 120 parts of toluene and 4 parts of 1% solution of Rose Bengal in methanol was mixed for dispersion on a ball mill for 6 hours. The mixture was then applied with a wire bar onto an aluminum plate of 0.05 mm in thickness so as to give a dry thickness of 40 microns and heated with warm air to evaporate off the solvent and obtain a photosensitive member of zinc oxide-binder type, which was then formed into a drum. The photosensitive member was subjected to corona discharge at −6 kV to be uniformly charged and then irradiated with an original image light, whereby an electrostatic latent image was formed.

The above mentioned toner was charged in a developing apparatus as shown in FIG. 1 and used to develop the electrostatic latent image obtained as described above. In this case, the toner carrying member 2 was a cylindrical sleeve of stainless steel having an outer diameter of 50 mm, the gap between the photosensitive drum and the sleeve 2 was set at 0.25 mm and a bias of an alternating current voltage of 1000 V at 400 Hz superposed with a direct current voltage of −150 V was applied to the sleeve. In this case, the toner layer formed on the toner carrying member had a gross electric charge per unit area of $9.0\times10^{-9}$ C(coulomb)/cm$^2$, a coating rate of 0.83 mg/cm$^2$, a thickness of 35 microns and a packing density of 0.24 g/cm$^3$.

Then, the developed toner image was transferred onto a paper while irradiating a direct current corona at −7 kV and fixed thereon to obtain a copied image. The fixing was conducted by a fixer of a commercially available plain paper copier (Trade name: NP-5000, mfd. by Canon K.K.).

The thus obtained copied image was a good blue image of a sufficiently high density as high as 1.28, without fog at all, free from scattering of toner around and having a high resolution. The copying was continuously repeated with the above toner for examination of the durability, copied images even after copying of 10,000 sheets were not inferior at all to the images obtained at the initial stage.

When the environmental conditions were changed to 35° C. and 85% R.H., the image density was 1.21, which was a value substantially unchanged from that under normal temperature and normal humidity (i.e. 22° C., 60% R.H.) conditions, and clear blue images could be obtained without fog and scattering of the toner, indicating substantially the same performances up to 10000 sheets of copying. Then, when transferred images were obtained at a low temperature and a low humidity of 10° C. and 10%, the image densities were found to be high up to 1.33, and the solid image portions could be developed and transferred very smoothly to give excellent images without scattering or drop-off of the toner. When successive copying was conducted under these environmental conditions, both continuously and intermittently, the density fluctuation was within ±0.2 up to 10,000 sheets of copying, thus showing satisfactory results in practical applications.

COMPARATIVE EXAMPLE 1

The procedure of Example 1 was repeated except that the pressure for pushing the toner application means 4 onto the toner carrying member 2 was increased, whereby a partial drop-off of image occurred to leave white portions.

In this case, the toner layer on the toner carrying member showed an electric charge per unit area of $70\times10^{-9}$ C/cm$^2$, a coating rate of 0.81 mg/cm$^2$, thickness of 11 microns and a packing density of 0.74 g/cm$^3$.

COMPARATIVE EXAMPLE 2

The procedure of Example 1 was repeated except that the pressure for pushing the toner application means 4 onto the toner carrying member 2 was decreased, whereby serious fog was observed on the resultant images.

In this case, the toner layer on the toner carrying member showed an electric charge per unit area of $0.2\times10^{-9}$ C/cm$^2$, a coating rate of 0.98 mg/cm$^2$, a thickness of 107 microns and a packing density of 0.092 g/cm$^3$.

EXAMPLE 2

A developing operation was carried out by using the toner of Example 1 and an apparatus shown in FIG. 2. The vibrating member 16 was vibrated at a frequency of 50 Hz and an amplitude of 0.2 mm, and the toner carrying member 2 was rotated at a peripheral speed of 120 mm/sec., whereby a uniformly applied layer of toner was formed on the toner carrying member. The toner carrying member 2 was faced to the electrostatic image bearing member 1 with a gap of about 300 microns, and an alternating bias of a frequency of 100 Hz to several kHz, a minus peak voltage of −660 to −1200 V and a plus peak voltage of +400 to +800 V was applied to the toner carrying member 2, whereby developing was conducted to result in similarly good results.

In this case, the toner layer on the toner carrying member showed an electric charge per unit area of $12\times10^{-9}$ C/cm$^2$, a coating rate of 0.65 mg/cm$^2$, a thickness of 25 microns and a packing density of 0.26 g/cm$^3$.

EXAMPLE 3

A toner (true density: 1.08) comprising styrene-acrylic-maleic anhydride copolymer, a Rhodamine-type red dye and Cr complex of alkylsalicylic acid was charged in an apparatus shown in FIG. 3, wherein the gap between the toner carrying member 2 and the application roller 35 was set at about 2 mm, the length of the brush was about 3 mm, and the gap between the carrying member and the electrostatic image bearing member of a CdS-NP photosensitive material was set at 300 microns, whereby a toner layer was formed on the toner carrying member 2.

Developing was conducted by applying a bias voltage with peak values of +700 V and −200 V given by superposing an alternating current component of a frequency of 200 Hz and peak voltages of ±450 V and a direct current component of 250 V, and transferring of the resultant developed image was conducted by applying a transfer voltage of +7 kV, whereby good results were similarly obtained.

In this case, the toner layer on the toner carrying member showed an electric charge per unit are of $-30\times10^{-9}$ C/cm$^2$, a coating rate of 0.73 mg/cm$^2$, a thickness of 23 microns and a packing density of 0.32 g/cm$^3$.

EXAMPLE 4

A mixture of 10 g of the toner of Example 3 and 50 g of ferrite carrier was charged in an apparatus as shown in FIG. 4 wherein the gap between the toner carrying member 2 and the magnetic roller 48 was set at about 2 mm, and the maximum thickness of the magnetic brush was set at about 3 mm. Thus, developing and transfer were conducted similarly as in Example 3, whereby good results were obtained similarly.

In this case, the toner layer on the toner carrying member showed an electric charge per unit area of $-45\times10^{-9}$ C/cm$^2$, a coating rate of 0.92 mg/cm$^2$, a thickness of 20 microns and a packing density of 0.46 g/cm$^3$.

EXAMPLE 5

A mixture of 20 g of the toner of Example 1 and 60 g of iron powder carrier prepared in advance was charged in an apparatus as shown in FIG. 5 wherein the gap between the regulating blade 58 and the toner carrying member 2 was set at about 250 microns. Developing and transfer were conducted similarly as in Example 1, whereby good results were obtained similarly.

In this case, the toner layer on the toner carrying member showed an electric charge per unit area of $6.0\times10^{-9}$ C/cm$^2$, a coating rate of 0.54 mg/cm$^2$, a thickness of 22 microns and a packing density of 0.25 g/cm$^3$.

EXAMPLE 6

Example 5 was similarly repeated except that a toner (true density of 1.02) comprising a polyester resin and a phthalocyanine pigment was used instead of the toner of Example 1; a CdS-NP photosensitive member was used as the electrostatic image bearing member, and the transfer voltage was changed to +7 kV, whereby good results were obtained similarly under several conditions.

In this case, the toner layer on the toner carrying member showed an electric charge per unit area of $-2.1\times10^{-9}$ C/cm$^2$, a coating rate of 1.1 mg/cm$^2$, a thickness of 60 microns and a packing density of 0.19 g/cm$^3$.

EXAMPLE 7

Example 5 was similarly repeated except that the toner of Example 1 was replaced by a toner (true density: 1.01) comprising styrene-aminoacrylic copolymer and an azo-type red pigment, whereby good results were obtained.

In this case, the toner layer on the toner carrying member showed an electric charge per unit area of $-0.8\times10^{-9}$ C/cm$^2$, a coating rate of 0.31 mg/cm$^3$, a thickness of 18 microns and a packing density of 0.17 g/cm$^3$.

EXAMPLE 8

Example 2 was similarly repeated except that the toner of Example 1 was replaced by the polyestertype toner of Example 6, a CdS-NP photosensitive member was used and the transfer voltage was changed to +7 kV, whereby generally good blue images were obtained while the image density was slightly lower.

In this case, the toner layer on the toner carrying member showed an electric charge per unit area of $-0.8\times10^{-9}$ C/cm$^2$, a coating rate of 0.31 mg/cm$^2$, a thickness of 18 microns and a packing density of 0.17 g/cm$^3$.

EXAMPLE 9

A mixture of 20 g of the toner of Example 1 and 60 g of the iron powder carrier prepared previously was charged in an apparatus shown in FIG. 6. In the apparatus, the gap between the tip of the magnetic blade 64 and the toner carrying member 2 was set at about 300 microns; the magnetic pole 62 was formed by a magnet with the maximum surface magnetic flux density of about 800 gauss, $\theta=35°$ and $\delta=85°$, whereby a thin uniform toner layer was formed on the toner carrying member 2.

In this case, the toner layer on the toner carrying member showed an electric charge per unit area of $6.5\times10^{-9}$ C/cm$^2$, a coating rate of 0.48 mg/cm$^2$, a thickness of 22 microns and a packing density of 0.22 g/cm$^3$.

The above mentioned apparatus was incorporated in a PC-10 copier (mfd. by Canon K.K.) and used under the conditions where the bias source 25 comprised an AC voltage of a frequency of 1600 Hz and a peak-to-peak value of 1300 V superposed with a DC voltage of −300 V, and the gap between the sleeve 2 and the OPC photosensitive member 1 was set at 250 microns, whereby good blue images were obtained. Developing was similarly conducted under the sets of environmental conditions of 35° C. and 85% R.H. and 10° C. and 10% R.H., whereby similarly good results were obtained. Further, the developing operation was continued for 10,000 sheets while supplying the toner, whereby clear images were also obtained continually.

EXAMPLE 10

A mixture of 20 g of the toner of Example 7 and 60 g of iron powder carrier prepared previously was charged in an apparatus shown in FIG. 6. In the apparatus, the gap between the tip of the magnetic blade 64 and the toner carrying member 2 was set at about 300 microns; the magnetic pole 62 was formed by a magnet with the maximum surface magnetic flux density of about 800 gauss, $\theta=35°$ and $\delta=85°$, whereby a thin uniform toner layer was formed on the toner carrying member 2.

In this case, the toner layer on the toner carrying member showed an electric charge per unit area of $4.6\times10^{-9}$ C/cm$^2$, a coating rate of 0.55 mg/cm$^2$, a thickness of 24 microns and a packing density of 0.23 g/cm$^3$.

The above mentioned apparatus was incorporated in a PC-10 copier (mfd. by Canon K.K.) and used under the conditions where the bias source 25 comprised an AC voltage of a frequency of 1600 Hz and a peak-to-peak value of 1300 V superposed with a DC voltage of −300 V, and the gap between the sleeve 2 and the OPC photosensitive member 1 was set at 250 microns, whereby good red images were obtained. Developing was similarly conducted under the sets of environmental conditions of 35° C. and 85% R.H., and 10° C. and 10% R.H., whereby similarly good results were obtained. Further, the developing operation was continued for 10,000 sheets while supplying the toner, whereby clear images were also obtained continually.

EXAMPLE 11

Example 10 was similarly repeated except that the toner was replaced by a toner (true density: 1.51) comprising 100 parts of styrene-2-ethylhexyl acrylate-diethylaminoethyl methacylate and 70 parts of $\alpha$-$Fe_2O_3$ particles (average particle size: 0.5 microns, non-magnetic), whereby a uniform toner layer was on the toner carrying member 2. The toner layer showed an electric charge per unit area of $3.9\times10^{-9}$ C/cm$^2$, a coating rate of 1.15 mg/cm$^2$, a thickness of 23 microns and a packing density of 0.50 g/cm$^3$.

Developing was satisfactorily carried out similarly as in Example 10 to give satisfactory sepia images under the several environmental conditions and the successive operation.

What is claimed is:

1. A developing method comprising:

providing an electrostatic image bearing member for bearing an electrostatic image on the surface thereof and a metal roller as a toner carrying member for carrying a substantially non-magnetic toner on the surface thereof so that the electrostatic image bearing member and the toner carrying member face each other with a gap of about 100 to 500 microns therebetween at a developing station, causing the toner to be carried on the metal roller to form a toner layer having a thickness of about 15 to 80 microns and less than said gap, and causing the toner to be transferred across the gap onto the electrostatic image bearing member at the developing station, wherein the toner is triboelectrically charged and the toner layer at the developing station has a gross electric charge per unit area of Q coulomb/cm$^2$ satisfying the relationship:

$$3\times10^{-10}\leqq|Q|\leqq10^{-7}$$

and has a packing density of 0.1 to 0.6 g/cm$^3$.

2. The developing method according to claim 1, wherein said gross electric charge per unit area Q of the toner on the toner carrying member satisfies the relationship:

$$5\times10^{-10}\leqq|Q|\leqq5\times10^{-8}.$$

3. The developing method according to claim 1, wherein the substantially non-magnetic toner has a saturation magnetization of 0–10 emu/g when measured in an extent magnetic field of 5000 Oersted.

4. The developing method according to claim 1, wherein the substantially non-magnetic toner has a true density of 1.2 or below.

5. The developing method according to claim 1, wherein the toner layer carried on the toner carrying member has a packing density of 0.15 to 0.5 g/cm$^3$.

6. The developing method according to claim 1, wherein the toner carrying member comprises a cylinder of stainless steel.

7. The developing method according to claim 1, wherein the toner carrying member comprises a cylinder of aluminum.

8. The developing method according to claim 1, wherein the electrostatic image is developed by the toner while an alternating current bias and/or direct current bias is aplied between the toner carrying member and the electrostatic image bearing member at the developing station.

9. The developing method according to claim 1, wherein the gap between the electrostatic image bearing member and the toner carrying member is about 150 to 300 microns.

* * * * *

UNITED STATES PATENT AND TRADEMARK OFFICE

CERTIFICATE OF CORRECTION

PATENT NO. : 4,666,815

DATED : May 19, 1987

INVENTOR(S) : EIICHI IMAI, ET AL.

It is certified that error appears in the above-identified patent and that said Letters Patent is hereby corrected as shown below:

COLUMN 4

Line 59, "member" should read --member.--.

COLUMN 7

Line 12, "developer 43" should read --developer 53--.

COLUMN 9

Line 42, "durability, copied" should read --durability. Copied--.
Line 52, "10000" should read --10,000--.

COLUMN 10

Line 65, "are" should be deleted.

COLUMN 11

Line 61, "polyestertype" should read --polyester-type--.

COLUMN 13

Line 2, "methacylate" should read --methacrylate--.
Line 4, "was" should read --was formed--.

UNITED STATES PATENT AND TRADEMARK OFFICE

CERTIFICATE OF CORRECTION

PATENT NO. : 4,666,815

DATED : May 19, 1987

INVENTOR(S) : EIICHI IMAI, ET AL.

It is certified that error appears in the above-identified patent and that said Letters Patent is hereby corrected as shown below:

COLUMN 14

Line 27, "aplied" should read --applied--.

Signed and Sealed this

Fifth Day of January, 1988

*Attest:*

*Attesting Officer*

DONALD J. QUIGG

*Commissioner of Patents and Trademarks*